US011583743B2

(12) United States Patent
Huang et al.

(10) Patent No.: US 11,583,743 B2
(45) Date of Patent: Feb. 21, 2023

(54) ADJUSTABLE HANGING ASSEMBLY FOR FLOW GENERATING DEVICE

(71) Applicant: Intex Marketing Ltd., Tortola (VG)

(72) Inventors: Zhi Xiong Huang, Fujian (CN); Yingbiao Zhang, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 333 days.

(21) Appl. No.: 16/625,531

(22) PCT Filed: Jun. 22, 2018

(86) PCT No.: PCT/IB2018/054633
§ 371 (c)(1),
(2) Date: Dec. 20, 2019

(87) PCT Pub. No.: WO2018/235054
PCT Pub. Date: Dec. 27, 2018

(65) Prior Publication Data

US 2020/0269114 A1 Aug. 27, 2020

(30) Foreign Application Priority Data

Jun. 22, 2017 (CN) ..... 201720732625.6

(51) Int. Cl.
*A63B 69/12* (2006.01)
*E04H 4/14* (2006.01)

(52) U.S. Cl.
CPC ..... *A63B 69/125* (2013.01); *E04H 4/14* (2013.01); *A63B 2225/09* (2013.01)

(58) Field of Classification Search
CPC ..... A63B 69/125; E04H 4/0006; E04H 4/14
USPC ..... 4/491, 509, 541.1
See application file for complete search history.

(56) References Cited

U.S. PATENT DOCUMENTS

| | | | |
|---|---|---|---|
| 1,630,797 | A | 5/1927 | Marwick |
| 3,476,106 | A | 11/1969 | Ritz et al. |
| 3,534,413 | A | 10/1970 | Yven |
| 3,820,173 | A | 6/1974 | Weller |
| 4,115,878 | A | 9/1978 | Johnson et al. |
| 4,352,215 | A | 10/1982 | Laing |

(Continued)

FOREIGN PATENT DOCUMENTS

| | | | |
|---|---|---|---|
| CH | 707912 | A2 | 10/2014 |
| DE | 3408217 | A1 | 9/1985 |

(Continued)

OTHER PUBLICATIONS

Endless Pools, "Fastlane Pool: Cost effective and easy to install for a quality swim, year-round," available at http://www.endlesspools.com/fastlane-pool.php at least as early as Dec. 18, 2014, 1 page.

*Primary Examiner* — Tuan N Nguyen
(74) *Attorney, Agent, or Firm* — Faegre Drinker Biddle & Reath LLP

(57) ABSTRACT

A hanging assembly is disclosed for use with a flow generating device that produces a current in a pool. The hanging assembly includes a back supporting plate coupled to a side supporting plate where a plate angle is formed between the back supporting plate and the side supporting plate. The plate angle is adjustable such that a current angle of the current relative to a sidewall of the pool can be varied based on user preferences.

9 Claims, 7 Drawing Sheets

(56) References Cited

U.S. PATENT DOCUMENTS

| | | | | |
|---|---|---|---|---|
| 4,375,337 | A | | 3/1983 | Yerger |
| 4,379,438 | A | | 4/1983 | Peardon |
| 4,420,846 | A | | 12/1983 | Bonner |
| 4,502,168 | A | | 3/1985 | Jaworski |
| 4,523,340 | A | | 6/1985 | Watkins |
| 4,525,881 | A | | 7/1985 | Higginbotham |
| 4,561,133 | A | | 12/1985 | Laing |
| 4,665,572 | A | | 5/1987 | Davidson et al. |
| 4,731,887 | A | | 3/1988 | Henkin et al. |
| 4,763,366 | A | | 8/1988 | Moreland |
| 4,773,104 | A | | 9/1988 | Wang |
| 4,780,917 | A | | 11/1988 | Hancock |
| 4,801,378 | A | * | 1/1989 | Desjoyaux ..... E04H 4/1209 4/509 |
| 4,843,659 | A | | 7/1989 | Popovich et al. |
| 4,845,787 | A | | 7/1989 | Lior |
| 4,853,987 | A | | 8/1989 | Jaworski |
| 4,903,352 | A | | 2/1990 | Murakami |
| 4,907,304 | A | | 3/1990 | Davidson et al. |
| 4,920,588 | A | | 5/1990 | Watkins |
| 5,005,228 | A | | 4/1991 | Mermelstein |
| 5,044,021 | A | | 9/1991 | Murdock |
| 5,095,558 | A | | 3/1992 | Howard |
| 5,167,041 | A | | 12/1992 | Burkitt, III |
| 5,172,754 | A | | 12/1992 | Graber et al. |
| 5,226,408 | A | | 7/1993 | Drysdale |
| 5,291,621 | A | | 3/1994 | Mathis |
| 5,298,003 | A | | 3/1994 | Weihe et al. |
| 5,379,467 | A | | 1/1995 | Lochbaum |
| 5,408,708 | A | | 4/1995 | Mathis |
| 5,495,627 | A | | 3/1996 | Leaverton et al. |
| 5,570,481 | A | | 11/1996 | Mathis et al. |
| 5,597,288 | A | | 1/1997 | Hatanaka |
| 5,662,557 | A | | 9/1997 | Watterson et al. |
| 5,662,558 | A | | 9/1997 | Shannon, III |
| 5,758,369 | A | | 6/1998 | Takahashi et al. |
| 5,862,543 | A | | 1/1999 | Reynoso et al. |
| 5,915,849 | A | | 6/1999 | Dongo |
| 5,920,925 | A | | 7/1999 | Dongo |
| 5,983,416 | A | | 11/1999 | Idland |
| 6,000,073 | A | | 12/1999 | Eddington |
| 6,009,574 | A | | 1/2000 | Moreland |
| 6,030,180 | A | | 2/2000 | Clarey et al. |
| 6,065,161 | A | | 5/2000 | Mateina et al. |
| 6,123,274 | A | | 9/2000 | Perdreau et al. |
| 6,165,358 | A | | 12/2000 | Denkewicz et al. |
| 6,233,754 | B1 | | 5/2001 | Ajima |
| 6,263,522 | B1 | | 7/2001 | Dongo et al. |
| 6,454,523 | B1 | | 9/2002 | Loyd et al. |
| 6,578,207 | B1 | | 6/2003 | Fratilla |
| 6,592,341 | B1 | | 7/2003 | Olney |
| 6,675,404 | B2 | | 1/2004 | Brennan et al. |
| 6,688,845 | B2 | | 2/2004 | Josep |
| 6,692,645 | B1 | | 2/2004 | Gargas |
| 6,789,278 | B2 | | 9/2004 | Shea |
| 6,797,164 | B2 | | 9/2004 | Leaverton |
| 6,857,967 | B2 | | 2/2005 | Loyd et al. |
| 6,859,953 | B1 | | 3/2005 | Christensen |
| 6,968,581 | B2 | | 11/2005 | Christensen |
| 7,001,159 | B2 | | 2/2006 | Peterson et al. |
| 7,067,056 | B2 | | 6/2006 | Collins |
| 7,252,761 | B2 | | 8/2007 | Lamberts Van Assche |
| 7,493,665 | B2 | | 2/2009 | Williams |
| 7,526,820 | B2 | | 5/2009 | Murdock et al. |
| 7,531,092 | B2 | | 5/2009 | Hazlehurst |
| 7,676,977 | B1 | | 3/2010 | Cahill et al. |
| 7,712,161 | B2 | | 5/2010 | Reynolds, II |
| 7,818,826 | B2 | | 10/2010 | Schmidt et al. |
| 7,984,519 | B1 | | 7/2011 | Hall |
| 8,011,032 | B2 | | 9/2011 | Cline et al. |
| 8,104,110 | B2 | | 1/2012 | Caudill et al. |
| 8,141,180 | B2 | | 3/2012 | Hof |
| 8,186,517 | B2 | | 5/2012 | Bowman et al. |
| 8,214,936 | B2 | | 7/2012 | Thweatt, Jr. |
| 8,453,275 | B2 | | 6/2013 | May et al. |
| 8,607,372 | B2 | | 12/2013 | Hall |
| 8,689,370 | B2 | | 4/2014 | Fleischer |
| 8,702,387 | B2 | | 4/2014 | Gillette |
| 8,739,322 | B2 | | 6/2014 | Hof |
| 8,907,616 | B2 | | 12/2014 | Liu et al. |
| 9,599,429 | B1 | | 3/2017 | Davis |
| 9,979,182 | B2 | | 5/2018 | Lin et al. |
| 10,193,329 | B2 | | 1/2019 | Lin et al. |
| 11,198,049 | B2 | | 12/2021 | Huang et al. |
| 2003/0200604 | A1 | | 10/2003 | Loyd et al. |
| 2003/0218812 | A1 | | 11/2003 | Foote et al. |
| 2004/0040908 | A1 | | 3/2004 | Orava et al. |
| 2004/0148693 | A1 | | 8/2004 | Anderson |
| 2006/0021129 | A1 | | 2/2006 | Williams et al. |
| 2006/0124535 | A1 | | 6/2006 | Harbol |
| 2006/0137087 | A1 | | 6/2006 | Garreau et al. |
| 2006/0226060 | A1 | | 10/2006 | Mercer |
| 2006/0282943 | A1 | | 12/2006 | Vandecamp |
| 2007/0039876 | A1 | | 2/2007 | Gori |
| 2007/0094784 | A1 | | 5/2007 | Tran |
| 2007/0214560 | A1 | | 9/2007 | Chivers et al. |
| 2008/0016610 | A1 | | 1/2008 | Kuo et al. |
| 2008/0086810 | A1 | | 4/2008 | Le |
| 2008/0148470 | A1 | | 6/2008 | Ferriss et al. |
| 2009/0100589 | A1 | | 4/2009 | Peterson et al. |
| 2009/0133766 | A1 | | 5/2009 | Elnar |
| 2009/0158518 | A1 | | 6/2009 | Southon et al. |
| 2010/0058528 | A1 | | 3/2010 | Clarey |
| 2010/0064428 | A1 | | 3/2010 | Loyd et al. |
| 2010/0269251 | A1 | | 10/2010 | Demotts |
| 2011/0004993 | A1 | | 1/2011 | Frei |
| 2011/0247970 | A1 | | 10/2011 | Evingham |
| 2011/0253638 | A1 | | 10/2011 | Easland et al. |
| 2012/0090087 | A1 | | 4/2012 | Korupp et al. |
| 2012/0117724 | A1 | | 5/2012 | Caudill et al. |
| 2013/0031711 | A1 | | 2/2013 | Walsh et al. |
| 2013/0034430 | A1 | | 2/2013 | Braswell |
| 2013/0145539 | A1 | | 6/2013 | Cooke |
| 2013/0283563 | A1 | | 10/2013 | Fry et al. |
| 2013/0334113 | A1 | | 12/2013 | Erlich |
| 2014/0047632 | A1 | | 2/2014 | Hall |
| 2014/0101840 | A1 | | 4/2014 | Harder |
| 2014/0331398 | A1 | | 11/2014 | Walsh et al. |
| 2015/0295397 | A1 | | 10/2015 | Lin et al. |
| 2018/0372235 | A1 | | 12/2018 | Smith |
| 2019/0373349 | A1 | | 12/2019 | Carrasca et al. |
| 2021/0129002 | A1 | | 5/2021 | Huang et al. |

FOREIGN PATENT DOCUMENTS

| | | | |
|---|---|---|---|
| EP | 0614684 | A1 | 9/1994 |
| WO | 2014/071536 | A1 | 5/2014 |

* cited by examiner

ADJUSTABLE HANGING ASSEMBLY FOR FLOW GENERATING DEVICE

CROSS REFERENCE TO RELATED APPLICATION

This application claims priority to the following Chinese patent application, the disclosure of which is hereby expressly incorporated by reference herein in its entirety:

| Application No. | Filing Date |
|---|---|
| CN 201720732625.6 | Jun. 22, 2017 |

FIELD OF THE DISCLOSURE

The present disclosure relates to a flow generating device for pool applications, and more particularly, to a hanging assembly for a flow generating device in pool applications.

BACKGROUND OF THE DISCLOSURE

Swimming pools may be equipped with a flow generating device to generate a current in the pool. In some applications, booster pumps positioned in the pool wall are used to generate flow in the pool. In household above ground pools, flow generating devices are used and generally hang from the sidewall of the pool. In this configuration, the water outlet and subsequent current generated by the flow generating device is generally limited to a single direction that is perpendicular to the sidewall of the pool. Improvements in the foregoing are desired to provide greater variability in the current direction.

SUMMARY

The present disclosure provides a hanging assembly configured for use with a flow generating device that produces a current in a pool. The hanging assembly includes a back supporting plate coupled to a side supporting plate where a plate angle is formed between the back supporting plate and the side supporting plate. The plate angle is adjustable such that a current angle of the current relative to a sidewall of the pool can be varied based on user preferences.

In one form thereof, the present disclosure provides a hanging assembly for use with a flow generating device that produces a current in a pool. The hanging assembly includes a back supporting plate configured to support the flow generating device in the pool, a side supporting plate pivotably coupled to the back supporting plate such that an adjustable angle of at least about 90 degrees is formed between the back supporting plate and the side supporting plate, and a hanging unit coupled to at least one of the back supporting plate and the side supporting plate and configured to couple to a sidewall of the pool.

The adjustable angle between the back supporting plate and the side supporting plate may adjust a current angle of the current relative to the sidewall of the pool. The current angle may be adjustable from about 0 to about 90 degrees.

The side supporting plate and the back supporting plate may be coupled together by a hinged connector having a free configuration that allows movement between the side supporting plate and the back supporting plate, and a locked configuration that prevents movement between the side supporting plate and the back supporting plate. The hinged connector may include a first friction plate coupled to the back supporting plate, a second friction plate coupled to the side supporting plate, a pivot pin, and a nut threadably coupled to the pivot pin, wherein the nut releases the first and second friction plates in the free configuration and compresses the first and second friction plates in the locked configuration.

The hanging unit may be selectively coupled to the back supporting plate and the side supporting plate, such that, when the hanging unit is coupled to the back supporting plate, the back supporting plate is positioned adjacent to the sidewall of the pool and, when the hanging unit is coupled to the side supporting plate, the side supporting plate is positioned adjacent to the sidewall of the pool.

The hanging assembly may further include a pool supporting block selectively coupled to the back supporting plate and the side supporting plate, such that, when the hanging unit is coupled to the back supporting plate, the pool supporting block is positioned between the back supporting plate and the sidewall of the pool and, when the hanging unit is coupled to the side supporting plate, the pool supporting block is positioned between the side supporting plate and the sidewall of the pool.

In another form thereof, the present disclosure provides a hanging assembly including a back supporting plate configured to support a flow generating device that produces a current at a current angle relative to a sidewall of a pool, a hanging unit configured to couple to the sidewall of the pool, wherein the hanging assembly has a first configuration in which the back supporting plate is attached to the hanging unit and a second configuration in which the back supporting plate is pivotably coupled to the hanging unit to adjust the current angle. In the first configuration, the current angle may be about 90 degrees. In the second configuration, the current angle may be less than about 90 degrees.

The hanging assembly may further include a side supporting plate pivotably coupled to the back supporting plate by a hinged connector having a free configuration that allows movement between the side supporting plate and the back supporting plate and a locked configuration that prevents movement between the side supporting plate and the back supporting plate. The hinged connector may include a first friction plate coupled to the back supporting plate, a second friction plate coupled to the side supporting plate, a pivot pin, and a nut threadably coupled to the pivot pin, wherein the nut releases the first and second friction plates in the free configuration and compresses the first and second friction plates in the locked configuration.

A plate angle between the back supporting plate and the side supporting plate may be about 90 degrees or more.

The hanging assembly may further include a pool supporting block, wherein, in the first configuration, the pool supporting block is positioned between the back supporting plate and the sidewall of the pool and, in the second configuration, the pool supporting block is positioned between the side supporting plate and the sidewall of the pool.

In yet another form thereof, the present disclosure provides a hanging assembly including a hanging unit configured to couple to a sidewall of a pool, a back supporting plate configured to support a flow generating device that produces a current at a current angle relative to the sidewall of the pool, a side supporting plate configured to suspend from the hanging unit adjacent to the sidewall of the pool, the back supporting plate pivotably coupled to the side supporting plate to adjust the current angle.

The current angle may be adjustable from about 0 to about 90 degrees.

The side supporting plate and the back supporting plate may be coupled together by a hinged connector having a free configuration that allows movement between the side supporting plate and the back supporting plate and a locked configuration that prevents movement between the side supporting plate and the back supporting plate. The hinged connector may include a first friction plate coupled to the back supporting plate, a second friction plate coupled to the side supporting plate, a pivot pin, and a nut threadably coupled to the pivot pin, wherein the nut releases the first and second friction plates in the free configuration and compresses the first and second friction plates in the locked configuration. The hinged connector may be positioned along an edge of the flow generating device between a back surface and a side surface of the flow generating device.

The back supporting plate may be configured to suspend from the hanging unit adjacent to the sidewall of the pool. The current angle may be about 90 degrees when the back supporting plate is suspended from the hanging unit.

BRIEF DESCRIPTION OF THE DRAWINGS

The above-mentioned and other features and advantages of this disclosure, and the manner of attaining them, will become more apparent and will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
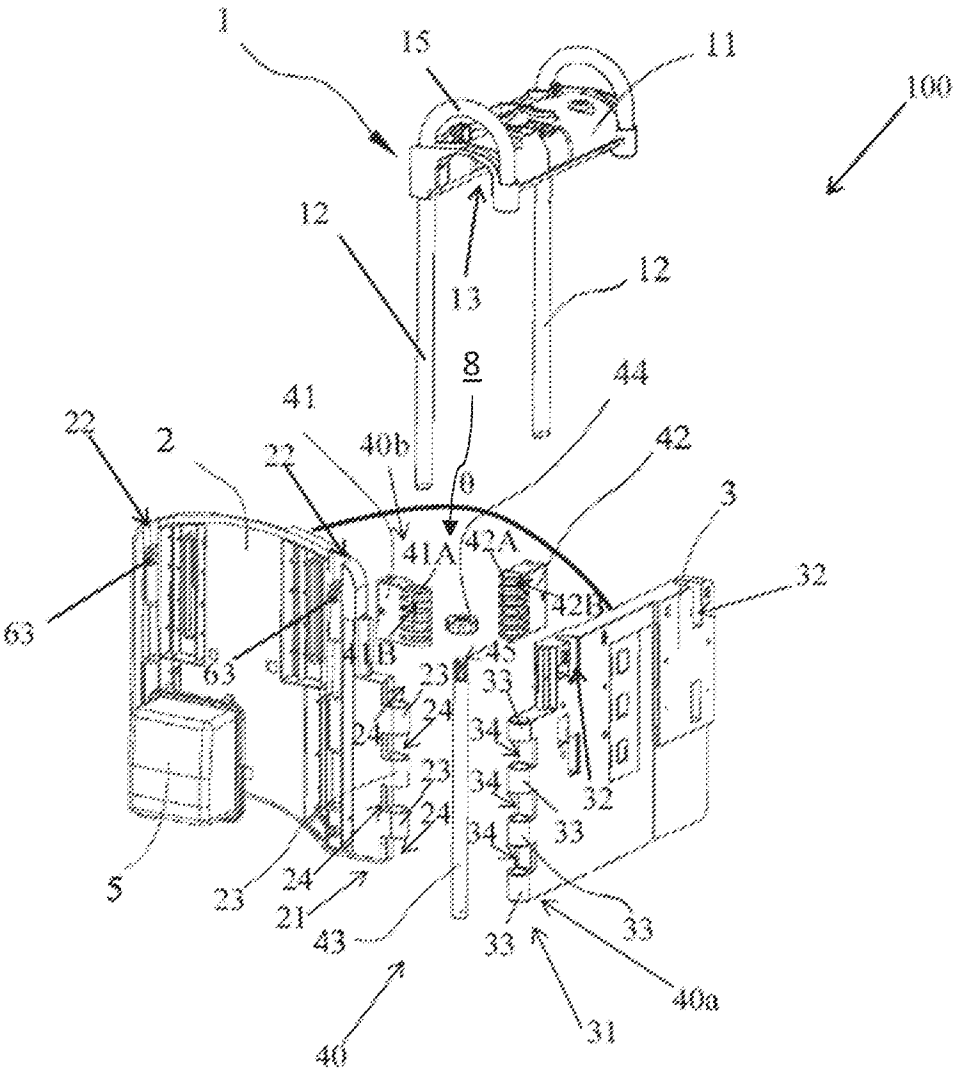
FIG. 1 is an exploded view of a hanging assembly for a flow generating device.

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Figure 2:
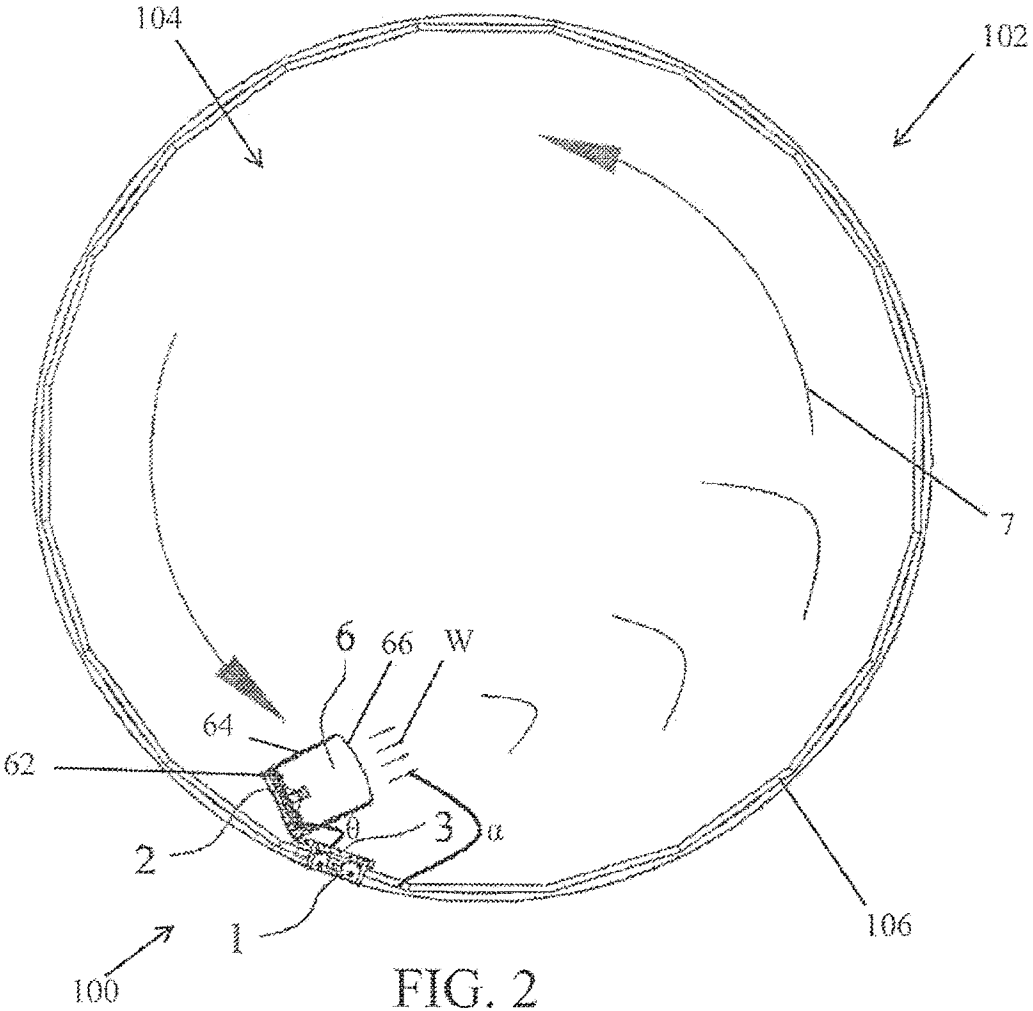
FIG. 2 is a top view of a pool having the hanging assembly of FIG. 1 with a flow generating device coupled to a sidewall of the pool of FIG. 1.

Referring first to FIGS. 1 and 2, a pool 102 includes a sidewall 106 that creates a cavity 104 containing water of pool 102. As shown in FIG. 2, a flow generating device 6 is positioned within cavity 104 of pool 102. Flow generating device 6 includes a back surface 62, two side surfaces 64, a front surface 66, and a motorized impeller (not shown) that receives water from pool 102 and directs the water through holes (not shown) in front surface 66 along arrows W to produce a current 7 within pool 102. Additional details regarding flow generating device 6 are disclosed in U.S. Pat. No. 9,979,182, the disclosure of which is hereby expressly incorporated by reference herein in its entirety.

As discussed further herein, the orientation of flow generating device 6 within pool 102 may be altered to provide different current 7 patterns within pool 102, specifically different current angles $\alpha$ between current 7 and the adjacent sidewall 106. Current angle $\alpha$ may be about 0 degrees to about 180 degrees, more specifically about 0 degrees to about 90 degrees. For example, in FIG. 2, current angle $\alpha$ is about 45 degrees, and in FIG. 7, current angle $\alpha$ is about 0 degrees (i.e., parallel to the adjacent sidewall 106). Because the illustrative pool 102 is circular, the resulting current 7 travels circumferentially about pool 102 in a counterclockwise direction in FIGS. 2 and 7. Alternatively, in FIG. 5, current angle $\alpha$ is about 90 degrees (i.e., perpendicular to the adjacent sidewall 106). Because the illustrative pool 102 is circular, the resulting current 7 travels in a substantially straight direction across the diameter of pool 102. It is also within the scope of the present disclosure that a clockwise current 7 can be provided by now generating device 6 depending on the orientation of flow generating device 6 within pool 102.

Flow generating device 6 is coupled to sidewall 106 of pool 102. In particular, a hanging assembly 100 operably couples flow generating device 6 to sidewall 106 of pool 102. Referring now to FIG. 1, hanging assembly 100 includes a hanging unit 1, a back supporting plate 2 configured to support back surface 62 of flow generating device 6, and a side supporting plate 3 moveably coupled to back supporting plate 2 via a hinged connector 40. The illustrative hinged connector 40 is positioned along pivot axis A, which follows the edge between back surface 62 and side surface 64 of flow generating device 6. Also, the illustrative hinged connector 40 has a free hinge portion **40*a* that supports free rotation of back supporting plate 2 and side supporting plate 3 about axis A and a friction hinge portion 40*b* that secures back supporting plate 2 and side supporting plate 3 in a desired plate angle $\theta$ about axis A. Hanging unit 1, back supporting plate 2, side supporting plate 3, and hinged connector 40 of hanging assembly 100 are each described further below. The back supporting plate 2 may serve as a first portion of the hanging assembly or a current device while the side supporting plate 3 may serve as a second portion of the hanging assembly or a current device. In other embodiments, the side supporting plate 3** may serve as a first portion of the hanging assembly or the current device while the back supporting plate may serve as a second portion of the hanging assembly or a current device.

Hanging unit 1 is selectively coupled to back supporting plate 2 and side supporting plate 3 and functions to couple the desired plate 2 or 3 of hanging assembly 100 onto sidewall 106 of pool 102. The illustrative hanging unit 1 includes a hooking unit 11 that includes a recess 13 contoured to receive or hook onto the upper surface of sidewall 106 such that hanging unit 1 suspends from the upper surface of sidewall 106. However, it is contemplated that alternate configurations of hooking unit 11 may be used to couple hanging unit 1 to sidewall 106. Hanging unit 1 also includes connecting rods 12 that are coupled to hooking unit 11. As shown in FIG. 1, connecting rods 12 are coupled to hooking unit 11 such that a portion of each connecting rod 12 extends above hooking unit 11 to provide a U-shaped handle 15 for a user to grasp for installation or removal of hanging unit 1 of hanging assembly 100.

Back supporting plate 2 may be coupled to back surface 62 of flow generating device 6 using one or more fasteners 63. Back supporting plate 2 includes recesses 22 configured to optionally receive connecting rods 12 of hanging unit 1. Back supporting plate 2 further includes a first half of free hinge portion 40*a* also referred to as a connecting column 21 that enables coupling of back supporting plate 2 to a second half of free hinge portion 40*a* on side supporting plate 3 as discussed further herein. Connecting column 21 is positioned at a side edge of back supporting plate 2 and includes a plurality of protrusions 23 with corresponding gaps 24 interposed between protrusions 23 as shown in FIG. 1. Protrusions 23 are hollowed to accommodate pivot pin 43 and are in substantial alignment with each other such that pivot pin 43 can be fed through protrusions 23 to couple back supporting plate 2 and side supporting plate 3 as discussed further herein.

Side supporting plate 3 can optionally abut or otherwise support a side surface 64 of flow generating device 6 depending on the configuration of hanging assembly 100 as discussed further herein. Similar to back supporting plate 2, side supporting plate 3 includes recesses 32 configured to optionally receive connecting rods 12 of hanging unit 1. Side supporting plate 3 further includes the second half of free hinge portion 40*a* also referred to as a connecting column 31 that enables a freely rotatable coupling of back supporting plate 2 to side supporting plate 3 as discussed further herein. Connecting column 31 is positioned at a side edge of side supporting plate 3 and includes a plurality of protrusions 33 with corresponding gaps 34 interposed between protrusions 33 as shown in FIG. 1. In addition, protrusions 33 and gaps 34 are positioned along connecting column 31 such that protrusions 33 can be received within gaps 24 of connecting column 21 and gaps 34 can receive protrusions 23 of connecting column 21 while maintaining alignment of protrusions 23, 33 when coupling back supporting plate 2 to side supporting plate 3. Furthermore, similar to protrusions 23, protrusions 33 are hollowed to accommodate pivot pin 43 and are in substantial alignment with each other such that pivot pin 43 can be fed through protrusions 23 to rotatably couple back supporting plate 2 and side supporting plate 3 as discussed further herein.

Figure 6:
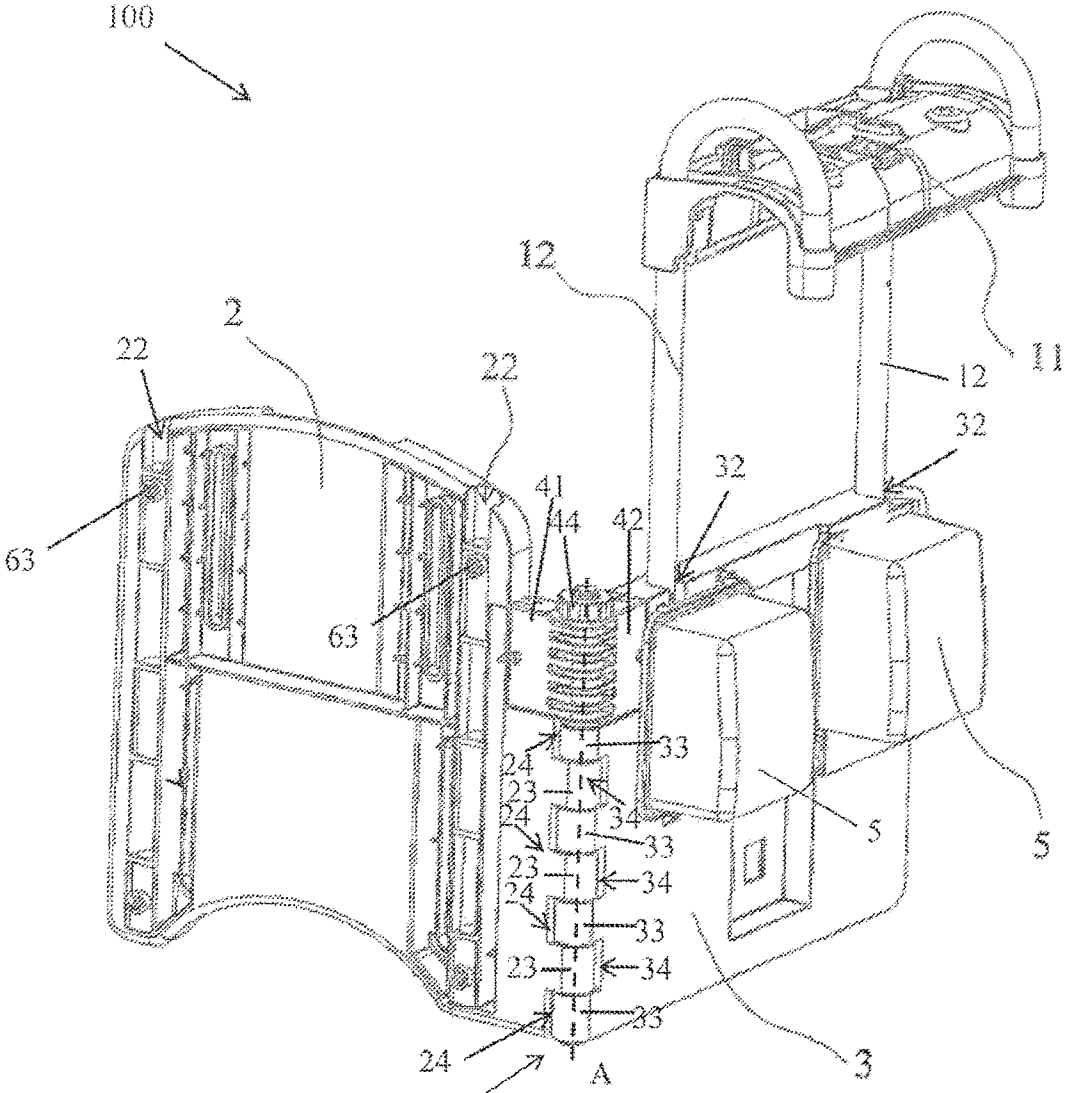
FIG. 6 is a perspective view of an alternate embodiment of the hanging assembly of FIG. 1.

As shown in FIG. 1, back supporting plate 2 further includes a detachable pool supporting block 5 to provide stability to hanging assembly 100 against sidewall 106 (especially a sloped sidewall 106) when in use with flow generating device 6 in pool 102. However, the positioning and number of pool supporting block 5 can vary depending on the assembled configuration of hanging assembly 100. Generally, the plate 2 or 3 that receives hanging unit 1 also includes pool supporting block 5 in order to provide stability to the corresponding plate 2 or 3 against sidewall 106 of pool 102. That is, pool supporting block 5 is selectively coupled to plate 2 and 3. For example, as shown in FIG. 6, side supporting plate 3 includes two detachable pool supporting blocks 5 to provide stability to hanging assembly 100 when in use.

The friction hinge portion 40*b* of connector 40 includes a first friction plate 41, a second friction plate 42, pivot pin 43, and a nut 44. First friction plate 41 and second friction plate 42 are coupled to back supporting plate 2 and side supporting plate 3, respectively. Similar to connecting columns 21, 31, first friction plate 41 and second friction plate 42 include hollow protrusions 41A, 42A that are spaced apart with gaps 41B, 42B therebetween, respectively. Also similar to protrusions 23 and 33, protrusions 41A, 42A are in substantial alignment with each other and with protrusions 23 and 33 such that pivot 43 can be fed through protrusions 41A, 42A as discussed further herein.

When coupling back supporting plate 2 to side supporting plate 3, friction plates 41, 42 interlock with each other such that protrusions 41A of first friction plate 41 can be received within gaps 42B of second friction plate 42 and protrusions 42A of first friction plate 41 can be received within gaps 41B of second friction plate 42. Similar to the engagement of protrusions 23, 33, the interlocking of protrusions 41A, 41B maintains the alignment among protrusions 41A, 41B. Furthermore, when coupling back supporting plate 2 to side supporting plate 3, protrusions 41A, 42A, 23, and 33 align to form a passage through which pivot pin 43 can be received.

Pivot pin 43 couples back supporting plate 2 to side supporting plate 3 when fed through the passage formed by the alignment of hollowed protrusions 41A, 42A, 23, and 33. An upper end of pivot pin 43 further includes threads 45 to threadingly engage with nut 44 to adjustably couple back supporting plate 2 and side supporting plate 3 as discussed further herein. For example, first friction plate 41, second friction plate 42, pivot pin 43, nut 44, or any combination thereof may form a biasing member 8 to adjustably couple back supporting plate 2 and side supporting plate 3 as discussed further herein.

Figure 3:
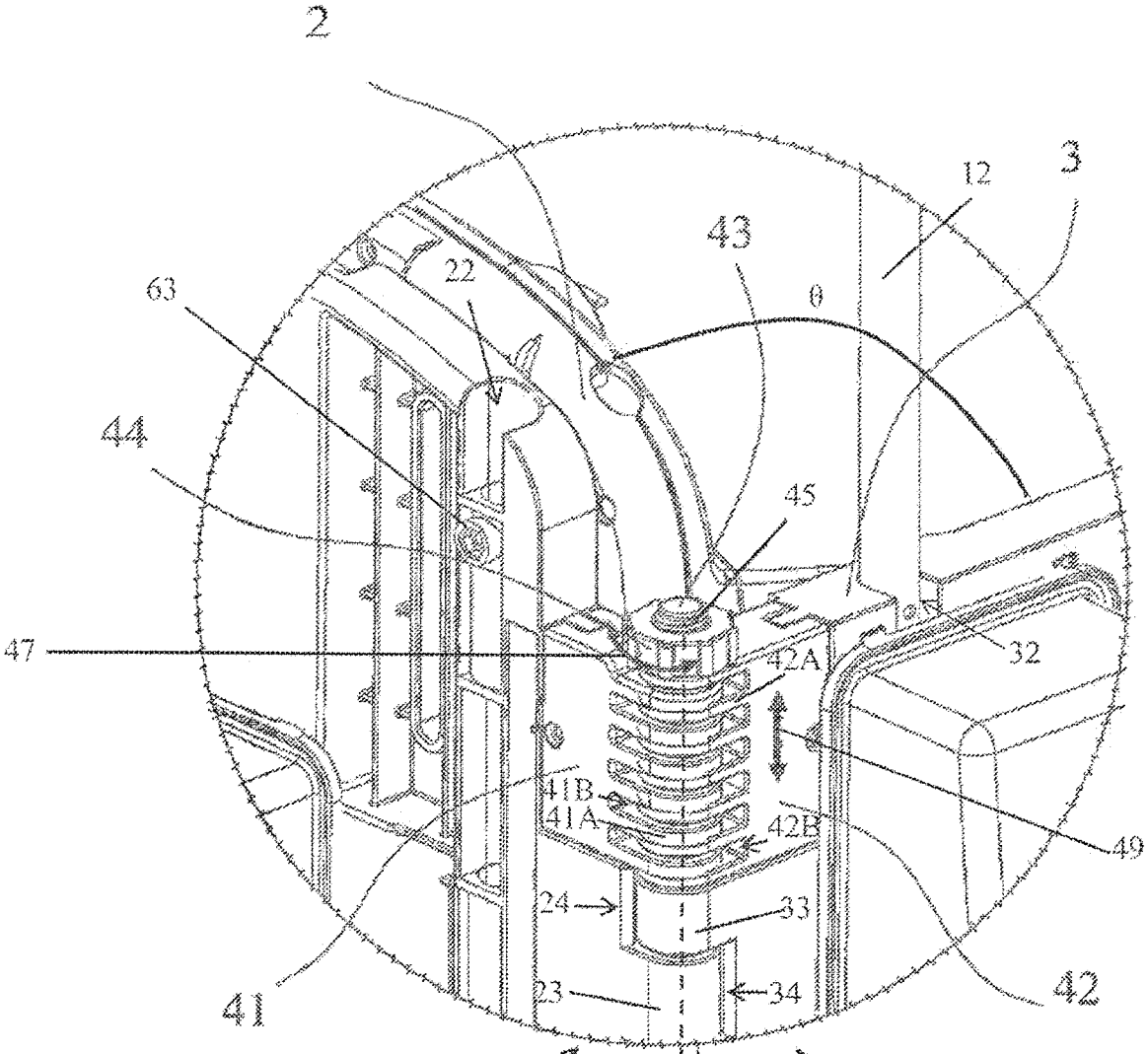
FIG. 3 is an enlarged, perspective view of the connection between a back supporting plate and a side supporting plate of the hanging assembly of FIG. 1.

As shown in FIG. 3, screw nut 44 is rotated about threads 45 of pivot pin 43 in directions 47 to move longitudinally along pivot pin 43 in corresponding directions 49. Pivot pin 43 cooperates with nut 44 to set or adjust the configuration of back supporting plate 3 and side supporting plate 2 based on the user's preferences. As mentioned previously, when coupling back supporting plate 3 and side supporting plate 2, pivot pin 43 is inserted through a passage formed by protrusions 41A, 42A, 23, and 33. When pivot pin 43 is inserted through the passage, threads 45 are exposed above friction plates 41, 42. In this configuration, back supporting plate 2 and side supporting plate 3 are freely movable about axis A of pivot pin 43 such that a plate angle θ between plates 2, 3 can be varied. In one embodiment, the plate angle θ is about 90 degrees (to accommodate flow generating device 6 between plates 2, 3) to about 180 degrees. Depending on the geometric shape of sidewall 106, it is also within the scope of the present disclosure for the plate angle θ to exceed 180 degrees in certain embodiments.

To set the plate angle θ of plates 2, 3, connector 40 is positioned in a locked configuration. In this locked configuration, screw nut 44 is tightened onto threads 45 of pivot pin 43 such that screw nut 44 moves downwardly along pivot pin 43 and engages with friction plates 41, 42. The bottom end of pivot pin 43 may be retained beneath plates 2, 3 with an enlarged head, a through-pin, or another suitable structure. Such engagement applies a compressive force onto friction plates 41, 42 such that protrusions 41A and 42A frictionally engage each other to resist or prevent movement of plates 2, 3 about axis A of pivot pin 43. That is, engagement of screw nut 44 onto friction plates 41, 42 provides enough friction between protrusions 41A and 42A to prevent substantial movement of back supporting plate 2 and side supporting plate 3 about pivot pin 43, thereby maintaining the plate angle θ between back supporting plate 2 and side supporting plate 3 and current angle α between current 7 and sidewall 106.

To adjust the plate angle θ of plates 2, 3, connector 40 is positioned in a free or unlocked configuration. In this free configuration, screw nut 44 is loosened from threads 45 of pivot pin 43 and moves upwardly along pivot pin 43, which releases the engagement of screw nut 44 with friction plates 41, 42 and reduces the frictional engagement between protrusions 41A, 42A of friction plates 41, 42, respectively. This reduced friction enables movement of plates 2, 3 about axis A (FIG. 3) to adjust the plate angle θ between back supporting plate 2 and side supporting plate 3 and current angle α between current 7 and sidewall 106. The adjustability of the plate angle θ via connector 40 (i.e., screw nut 44, pivot pin 43, and friction plates 41, 42) provides greater flexibility in the configurations of back supporting plate 2 and side supporting plate 3 of hanging assembly 100 relative to each other. Once the desired orientation of back supporting plate 2 and side supporting plate 3 is achieved for the desired plate angle θ and current angle α, screw nut 44 is rotated about threads 45 of pivot pin 43 to tighten engagement of friction plates 41, 42 as discussed previously.

Figure 4:
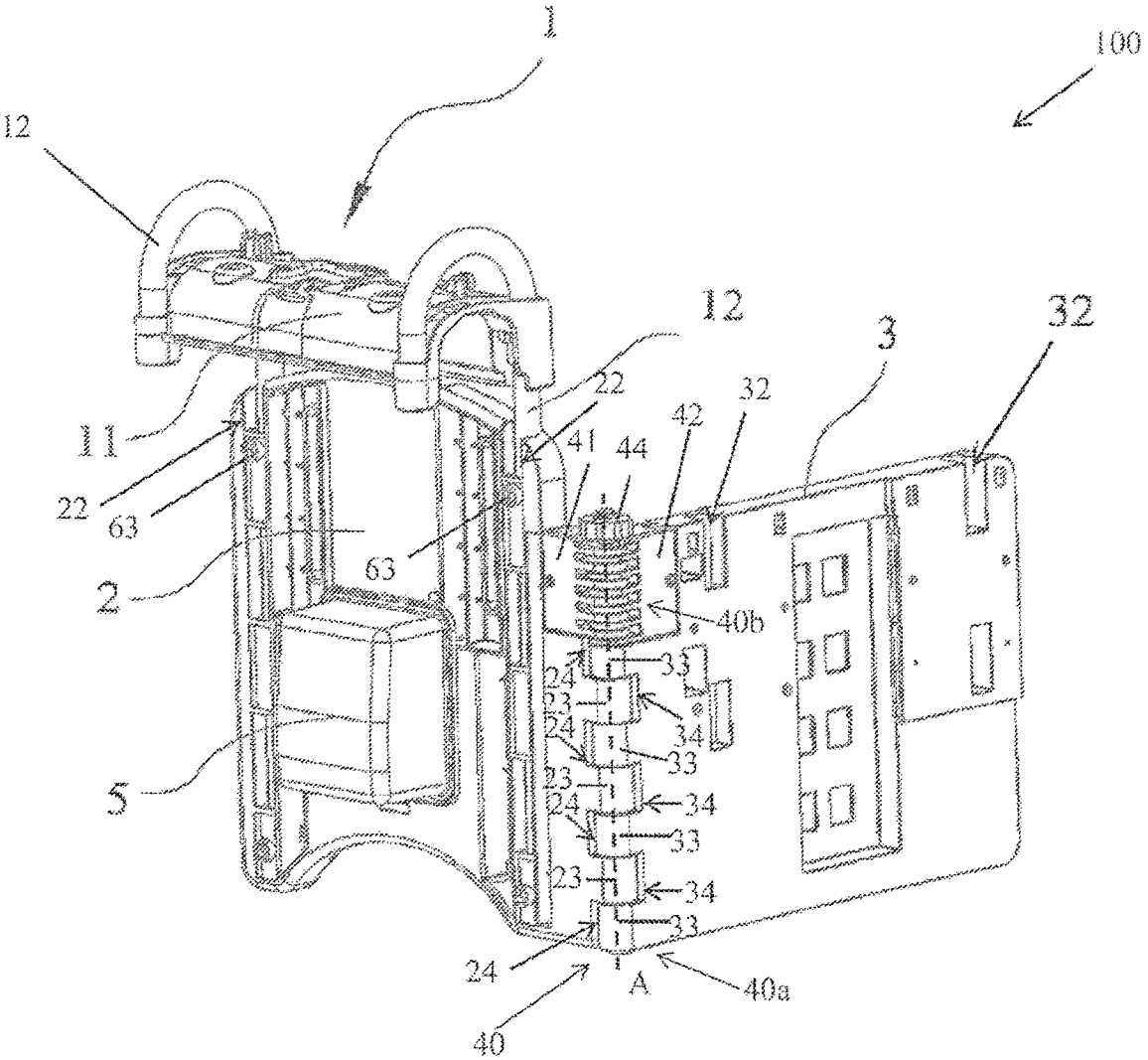
FIG. 4 is a perspective view of one embodiment of the hanging assembly of FIG. 1.
Figure 5:
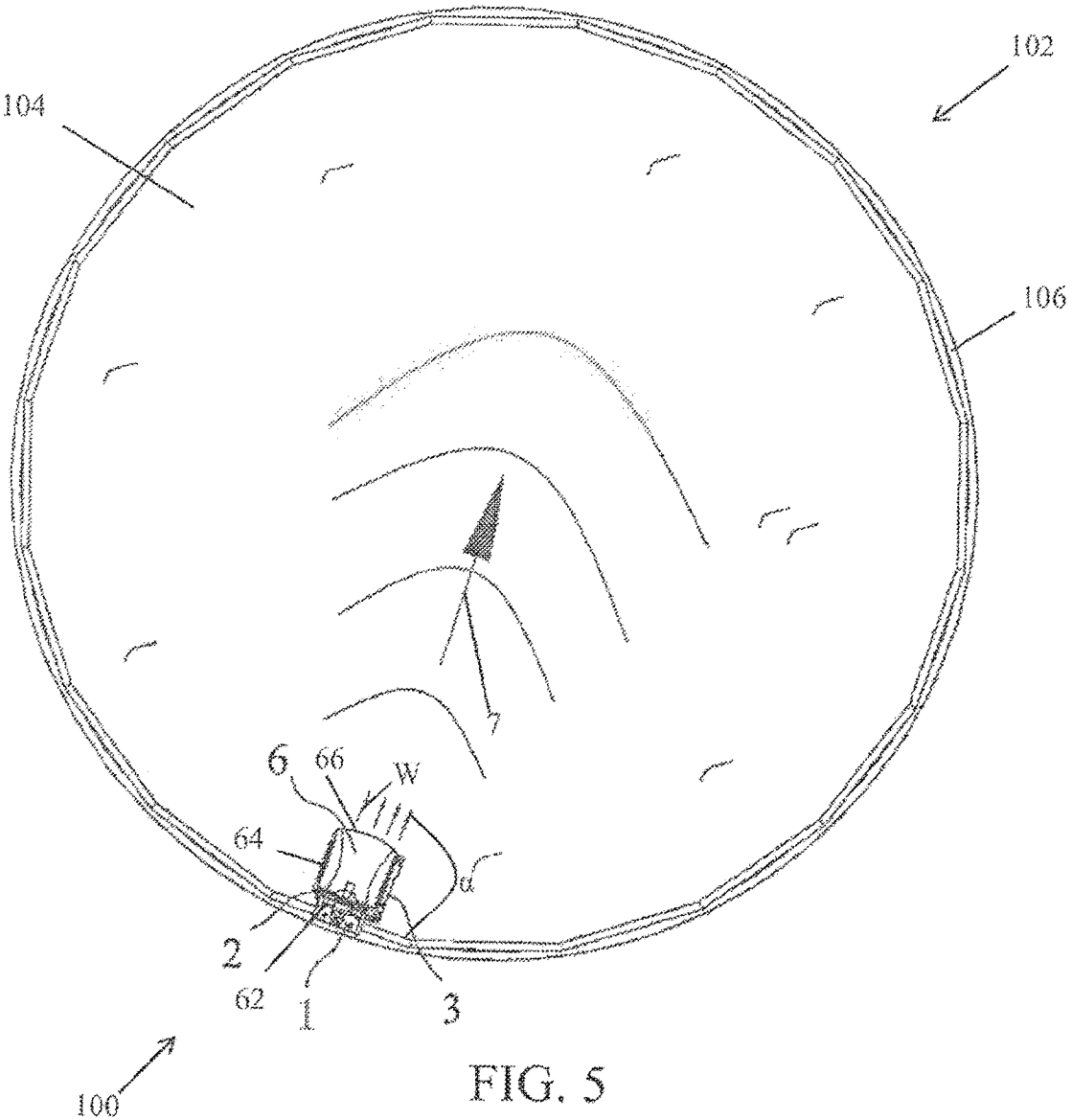
FIG. 5 is a top view of a pool having the hanging assembly of FIG. 4 with a flow generating device coupled to a sidewall of the pool.

Referring now to FIGS. 4 and 5, a first assembled configuration of hanging assembly 100 is shown. Connecting rods 12 of hanging unit 1 are received in recesses 22 of back supporting plate 2, and a detachable pool supporting block 5 is also provided on back supporting plate 2. Furthermore, the plate angle θ between back supporting plate 2 and side supporting plate 3 is around 90 degrees. As shown in FIG. 5, hanging unit 1 and back supporting plate 2 are coupled to sidewall 106. Back surface 62 of flow generating device 6 is received on back supporting plate 2 facing cavity 104, and side supporting plate 3 abuts the side surface 64 of flow generating device 6. In this first configuration, flow generating device 6 produces a current 7 having a current angle α that is substantially perpendicular to the sidewall 106 of pool 102 to which back surface 62 of flow generating device 6 is coupled.

Figure 7:
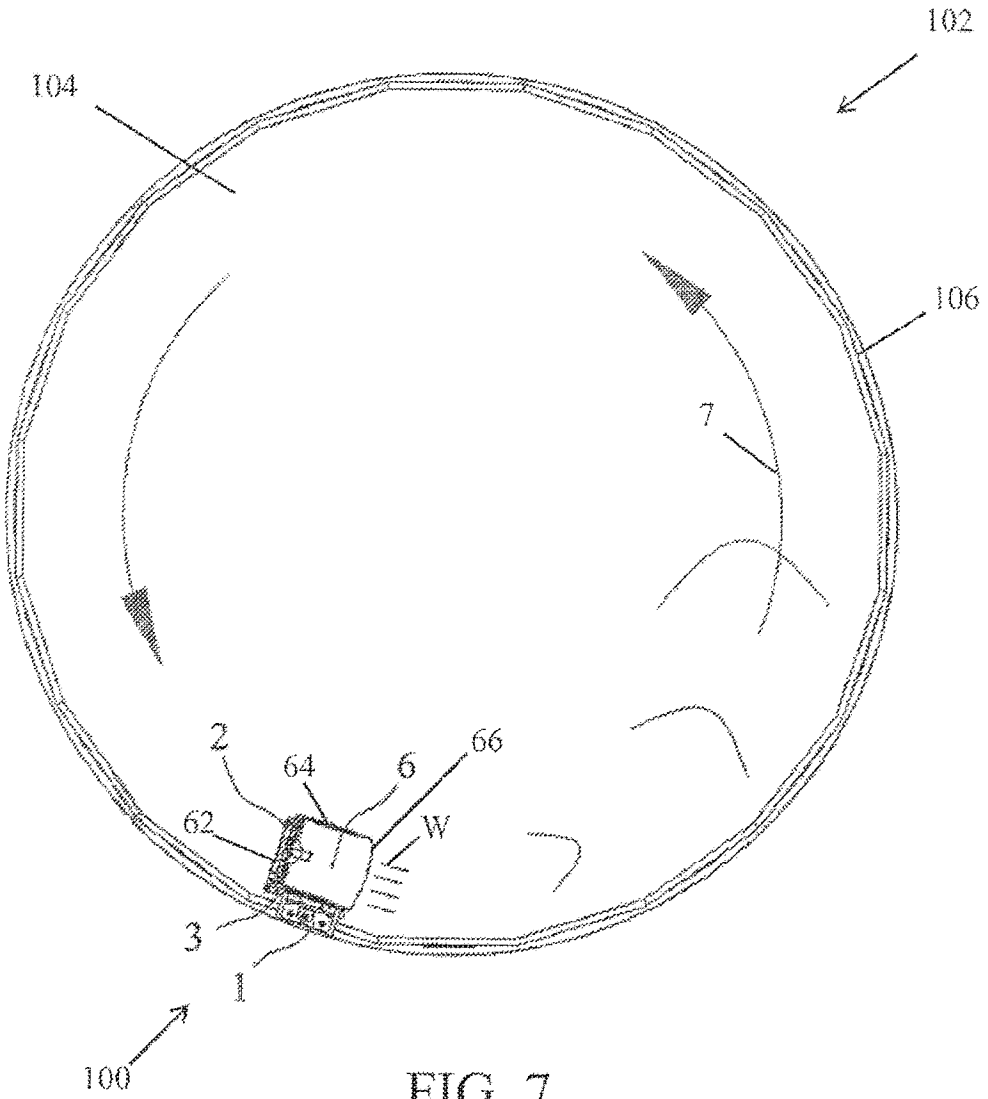
FIG. 7 is a top view of a pool having the hanging assembly of FIG. 6 with a flow generating device coupled to the sidewall of the pool.

Referring now to FIGS. 6 and 7, a second assembled configuration of hanging assembly 100 is shown. In this configuration, connecting rods 12 of hanging unit 1 are received in recesses 32 of side supporting plate 3, and detachable pool supporting blocks 5 are also provided on side supporting plate 3. Furthermore, the plate angle θ between back supporting plate 2 and side supporting plate 3 is around 90 degrees. As shown in FIG. 7, hanging unit 1 and side supporting plate 3 are coupled to sidewall 106. Back surface 62 of flow generating device 6 is received on back supporting plate 2 facing cavity 104, and side supporting plate 3 is coupled to side surface 64 of flow generating device 6. In this second configuration, flow generating device 6 produces a current 7 having a current angle α that is substantially parallel to the sidewall 106 of pool 102 to which side surface 64 of flow generating device 6 is coupled, and the current 7 continues in a counterclockwise direction around pool 102.

Finally, referring back to FIGS. 1 and 2, another assembled configuration of hanging assembly 100 is shown. In this configuration, connecting rods 12 of hanging unit 1 are received in recesses 32 of side supporting plate 3, and detachable pool supporting blocks 5 are provided on back supporting plate 2. Furthermore, the plate angle θ between back supporting plate 2 and side supporting plate 3 is greater than 90 degrees. As further shown in FIG. 2, hanging unit 1 and side supporting plate 3 are coupled to sidewall 106. Back surface 62 of flow generating device 6 is coupled to back supporting plate 2, but side surface 64 of flow generating device 6 is spaced apart from side supporting plate 3 due to the increased plate angle θ between back supporting plate 2 and side supporting plate 3. In this configuration, flow generating device 6 provides a current 7 having a current angle α of about 45 degrees relative to the sidewall 106 of pool 102 to which side supporting plate 3 and hanging unit 1 are coupled, and the current 7 continues in a counterclockwise direction around pool 102.

Advantageously, hanging assembly 100 provides for flexibility in assembly. By having recesses 22, 32 in both back supporting plate 2 and side supporting plate 3, hanging unit 1 can be coupled to either plate 2 or 3, and then the corresponding plate 2 or 3 can be coupled to sidewall 106 of pool 102. The ability to couple either plate 2 or 3 to the sidewall 106 allows the user to vary the configuration of flow generating device 6 within hanging assembly 100 and within pool 102, as shown in FIGS. 2, 5, and 7. Similarly, connector 40 allows the user to vary the plate angle θ between back supporting plate 2 and side supporting plate 3 which can alter the orientation of flow generating device 6, current 7, and current angle α as shown in FIGS. 2, 5, and 7. In other words, the user is provided with greater control over the orientation of flow generating device 6 and subsequent current angle α due to connector 40.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hanging assembly configured for use with a flow generating device that produces a current in a pool, the hanging assembly comprising:

a back supporting plate configured to support the flow generating device in the pool;

a side supporting plate pivotably coupled to the back supporting plate such that an adjustable angle of at least about 90 degrees is formed between the back supporting plate and the side supporting plate; and a hanging unit coupled to at least one of the back supporting plate and the side supporting plate and configured to couple to a sidewall of the pool, wherein the adjustable angle between the back supporting plate and the side supporting plate adjusts a current angle of the current relative to the sidewall of the pool, and wherein the current angle is adjustable from about 0 to about 90 degrees.

2. The hanging assembly of claim 1, wherein the side supporting plate and the back supporting plate are coupled together by a hinged connector having:

a free configuration that allows movement between the side supporting plate and the back supporting plate; and a locked configuration that prevents movement between the side supporting plate and the back supporting plate.

3. The hanging assembly of claim 2, wherein the hinged connector includes:

a first friction plate coupled to the back supporting plate;

a second friction plate coupled to the side supporting plate;

a pivot pin; and a nut threadably coupled to the pivot pin, wherein the nut releases the first and second friction plates in the free configuration and compresses the first and second friction plates in the locked configuration.

4. The hanging assembly of claim 1, wherein the hanging unit is selectively coupled to the back supporting plate and the side supporting plate, such that:

when the hanging unit is coupled to the back supporting plate, the back supporting plate is positioned adjacent to the sidewall of the pool; and when the hanging unit is coupled to the side supporting plate, the side supporting plate is positioned adjacent to the sidewall of the pool.

5. The hanging assembly of claim 4, further including a pool supporting block selectively coupled to the back supporting plate and the side supporting plate, such that:

when the hanging unit is coupled to the back supporting plate, the pool supporting block is positioned between the back supporting plate and the sidewall of the pool; and when the hanging unit is coupled to the side supporting plate, the pool supporting block is positioned between the side supporting plate and the sidewall of the pool.

6. The hanging assembly of claim 1, wherein the hanging unit is directly coupled to at least one of the back supporting plate and the side supporting plate.

7. A current device for use with a swimming pool having a sidewall, comprising:

a first portion including a hooking unit having a recess on a lower side, the recess contoured to receive an upper surface of the sidewall of the pool in use;

a second portion including a flow generating device which produces a current in a first direction; the second portion movably coupled to the first portion to permit a movement of the second portion relative to the first portion in a first degree of freedom, wherein the first portion includes a plurality of vertically spaced apart grooves formed by a first plurality of protrusions and the second portion includes a second plurality of protrusions, a first protrusion of the second plurality of protrusions of the second portion being received in a first groove of the plurality of vertically spaced apart grooves of the first portion when the second portion is held in a first position relative to the first portion and a second protrusion of the second plurality of protrusions of the second portion being received in a second groove of the plurality of vertically spaced apart grooves of the first portion when the second portion is held in the first position relative to the first portion by a biasing member, and wherein the second portion is movable to a second position relative to the first portion in the first degree of freedom, a spacing between a front exterior surface the flow generating device being further separated from the hooking unit when the second portion is in the second position relative to the first portion than when the second portion is in the first position relative to the first portion, the second portion is held in the second position relative to the first portion by the biasing member; and a sidewall support positioned between the second portion and the sidewall of the swimming pool in use.

8. A hanging assembly configured for use with a flow generating device that produces a current in a pool, the hanging assembly comprising:

a back supporting plate configured to support the flow generating device in the pool;

a side supporting plate pivotably coupled to the back supporting plate such that an adjustable angle of at least about 90 degrees is formed between the back supporting plate and the side supporting plate; and a hanging unit coupled to at least one of the back supporting plate and the side supporting plate and configured to couple to a sidewall of the pool, wherein the hanging unit is selectively coupled to the back supporting plate and the side supporting plate, such that:

when the hanging unit is coupled to the back supporting plate, the back supporting plate is positioned adjacent to the sidewall of the pool; and when the hanging unit is coupled to the side supporting plate, the side supporting plate is positioned adjacent to the sidewall of the pool.

9. The hanging assembly of claim 8, further including a pool supporting block selectively coupled to the back supporting plate and the side supporting plate, such that:

when the hanging unit is coupled to the back supporting plate, the pool supporting block is positioned between the back supporting plate and the sidewall of the pool; and when the hanging unit is coupled to the side supporting plate, the pool supporting block is positioned between the side supporting plate and the sidewall of the pool.

* * * * *